US012098617B2

(12) United States Patent
Underbrink

(10) Patent No.: US 12,098,617 B2
(45) Date of Patent: Sep. 24, 2024

(54) DUAL BALL SEAT SYSTEM

(71) Applicant: Schlumberger Technology Corporation, Sugar Land, TX (US)

(72) Inventor: Michael Underbrink, Eureka, MO (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/255,467

(22) PCT Filed: Nov. 19, 2021

(86) PCT No.: PCT/US2021/060112

§ 371 (c)(1),
(2) Date: Jun. 1, 2023

(87) PCT Pub. No.: WO2022/119728

PCT Pub. Date: Jun. 9, 2022

(65) Prior Publication Data

US 2024/0102357 A1 Mar. 28, 2024

Related U.S. Application Data

(60) Provisional application No. 63/121,533, filed on Dec. 4, 2020.

(51) Int. Cl.
*E21B 34/14* (2006.01)
*E21B 34/10* (2006.01)

(52) U.S. Cl.
CPC ..... *E21B 34/14* (2013.01); *E21B 34/10* (2013.01)

(58) Field of Classification Search
CPC ..... E21B 34/10; E21B 34/103; E21B 34/14; E21B 2200/04
See application file for complete search history.

(56) References Cited

U.S. PATENT DOCUMENTS 4,576,234 A 3/1986 Upchurch
4,633,952 A * 1/1987 Ringgenberg ..... E21B 43/25 166/321

(Continued)

FOREIGN PATENT DOCUMENTS

CN 204878826 U 12/2015
EP 2578798 A1 4/2013
WO 2015052499 A2 4/2015

OTHER PUBLICATIONS

International Preliminary Report on Patentability issued in PCT Application PCT/US2021/060112 dated Jun. 15, 2023, 7 pages.

(Continued)

*Primary Examiner* — Shane Bomar
(74) *Attorney, Agent, or Firm* — Jeffrey D. Frantz

(57) ABSTRACT

A system includes rotational ball seat (RBS), remote operated, and electrical/hydraulic sections. The RBS section includes a spring, a first internal sleeve, and an upper RBS. The remote operated section includes a lower rotational ball valve (RBV) disposed between second and third internal sleeves, and a setting sleeve operatively connected to the lower RBV. During miming-in-hole, the upper RBS is in a restricted position, and the lower RBV is in an open position. The spring compresses the internal sleeves, which sandwich the upper RBS and the lower RBV, until a shear event occurs. An inner diameter of the system closes to facilitate setting of hydraulic equipment. Thereafter, the shear event releases the spring, thereby pushing the internal sleeves, the upper RBS, and the lower RBV downhole, which rotates the upper RBS and the lower RBV into open positions, thereby opening the inner diameter of the system.

18 Claims, 5 Drawing Sheets

(56) References Cited

U.S. PATENT DOCUMENTS

| | | | | |
|---|---|---|---|---|
| 5,609,178 | A | 3/1997 | Hennig et al. | |
| 5,706,892 | A * | 1/1998 | Aeschbacher, Jr. | E21B 49/087 166/69 |
| 5,865,246 | A | 2/1999 | Brown | |
| 6,070,672 | A | 6/2000 | Gazda | |
| 6,557,637 | B1 * | 5/2003 | Dore | E21B 34/04 166/359 |
| 6,945,331 | B2 | 9/2005 | Patel | |
| 7,108,073 | B2 | 9/2006 | Patel | |
| 7,201,232 | B2 | 4/2007 | Turner | |
| 7,337,850 | B2 | 3/2008 | Contant | |
| 7,510,001 | B2 | 3/2009 | Spring et al. | |
| 7,597,151 | B2 | 10/2009 | Curtis et al. | |
| 7,967,071 | B2 | 6/2011 | Brown | |
| 8,113,286 | B2 | 2/2012 | Beall et al. | |
| 8,201,632 | B2 | 6/2012 | Burnett | |
| 8,215,396 | B2 | 7/2012 | Barbee | |
| 8,225,871 | B2 | 7/2012 | Beall | |
| 8,281,865 | B2 | 10/2012 | Joseph | |
| 8,316,953 | B2 | 11/2012 | Reid | |
| 8,327,945 | B2 | 12/2012 | Gette | |
| 8,393,396 | B2 | 3/2013 | Brien | |
| 8,403,063 | B2 | 3/2013 | Inglis | |
| 8,453,748 | B2 | 6/2013 | Vick, Jr. | |
| 8,517,113 | B2 | 8/2013 | Sheffield | |
| 8,522,886 | B2 | 9/2013 | Christie | |
| 8,534,317 | B2 | 9/2013 | Plunkett | |
| 8,607,882 | B2 | 12/2013 | Kalb | |
| 8,622,130 | B2 | 1/2014 | Barbee | |
| 8,651,174 | B2 | 2/2014 | Barbee | |
| 8,684,099 | B2 | 4/2014 | Azimi et al. | |
| 8,733,448 | B2 | 5/2014 | Skinner et al. | |
| 8,752,653 | B2 | 6/2014 | Seneviratne | |
| 8,763,707 | B2 | 7/2014 | Williamson | |
| 8,800,468 | B2 | 8/2014 | VanNimwegen | |
| 8,833,468 | B2 | 9/2014 | Swan | |
| 8,905,145 | B2 | 12/2014 | Napier | |
| 8,997,850 | B2 | 4/2015 | Barbee | |
| 9,121,250 | B2 | 9/2015 | Godfrey et al. | |
| 9,133,682 | B2 | 9/2015 | Tahoun | |
| 9,200,501 | B2 | 12/2015 | Patton | |
| 9,222,334 | B2 | 12/2015 | Erkol | |
| 9,284,816 | B2 | 3/2016 | Radford | |
| 9,322,242 | B2 | 4/2016 | Buchan | |
| 9,341,040 | B2 | 5/2016 | Barbee | |
| 9,453,388 | B2 | 9/2016 | Tahoun | |
| 9,528,346 | B2 | 12/2016 | Turley | |
| 9,689,226 | B2 | 6/2017 | Barbee | |
| 9,869,153 | B2 | 1/2018 | Moreno et al. | |
| 10,208,556 | B2 | 2/2019 | Barbee | |
| 10,221,652 | B2 | 3/2019 | Inglis | |
| 10,233,725 | B2 | 3/2019 | Provost | |
| 10,415,347 | B2 | 9/2019 | Reid | |
| 10,533,396 | B2 | 1/2020 | McNeilly | |
| 10,550,661 | B2 | 2/2020 | Barbee | |
| 10,704,383 | B2 | 7/2020 | Andreychuk | |
| 10,731,445 | B2 | 8/2020 | Akkerman | |
| 10,774,615 | B2 | 9/2020 | Froehling | |
| 2002/0007950 | A1 | 1/2002 | Simpson | |
| 2004/0163820 | A1 * | 8/2004 | Bishop | E21B 34/142 166/373 |
| 2005/0252556 | A1 | 11/2005 | Williams | |
| 2010/0084146 | A1 | 4/2010 | Roberts | |
| 2012/0037380 | A1 * | 2/2012 | Arizmendi, Jr. | E21B 34/06 166/332.8 |
| 2015/0159469 | A1 * | 6/2015 | Purkis | E21B 47/06 166/185 |
| 2016/0024872 | A1 | 1/2016 | Castro | |
| 2016/0102525 | A1 | 4/2016 | Ross | |
| 2016/0245041 | A1 * | 8/2016 | Deacon | E21B 33/076 |
| 2018/0187514 | A1 | 7/2018 | Inglis | |
| 2019/0249549 | A1 | 8/2019 | Fripp | |
| 2019/0316440 | A1 | 10/2019 | Honeker | |
| 2020/0080397 | A1 * | 3/2020 | Walker | F16K 5/0652 |
| 2020/0300374 | A1 | 9/2020 | Milne | |

OTHER PUBLICATIONS

Rotational Ball Seat (RBS), downloaded on May 30, 2023 from link https://www.slb.com/completions/well-completions/liner-hangers/rbs-rotational-ball-seat (1 page).

International Search Report and Written Opinion issued in PCT Application PCT/US2021/060112, dated Mar. 8, 2022 (10 pages).

* cited by examiner

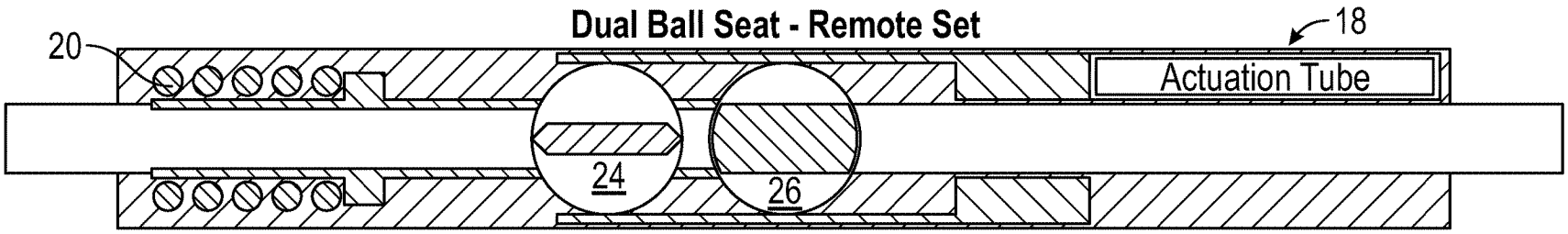

RIH Position. Spring compressed, "Blanked" Rotational Ball in the open position, and the Ball Seat Rotational Ball is in the restricted position.

FIG. 4A

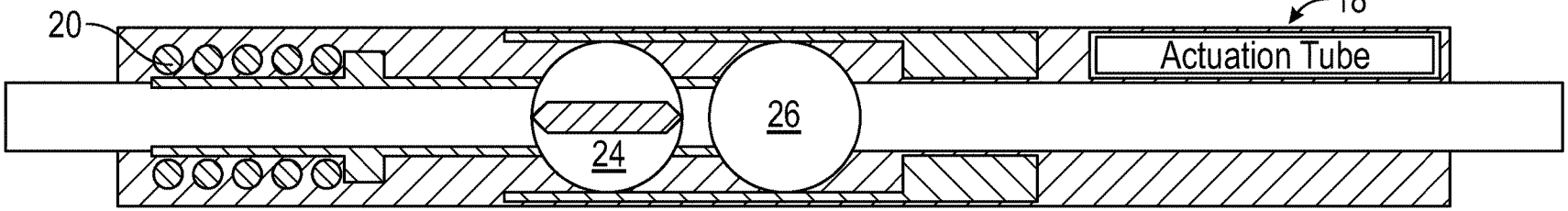

Actuation Tube receives the signal from surface and fires the ERD. Control arms rotate only the blanked rotational ball to the closed position. Spring still compressed.

FIG. 4B

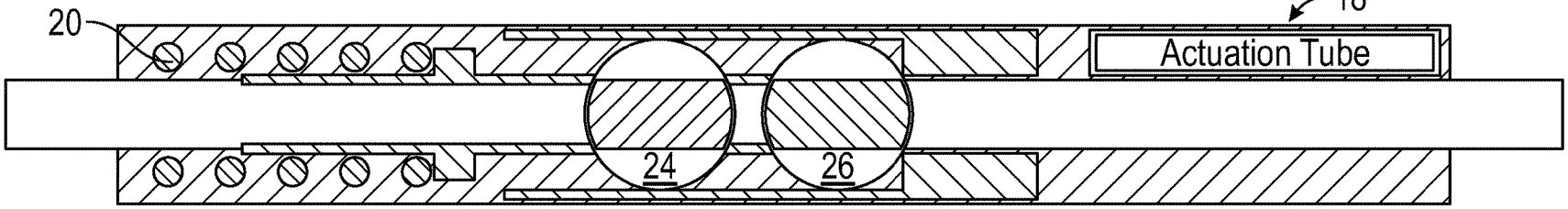

Pressure is increased until a shear event that releases the spring force and pushes both rotational balls into the open position.

FIG. 4C

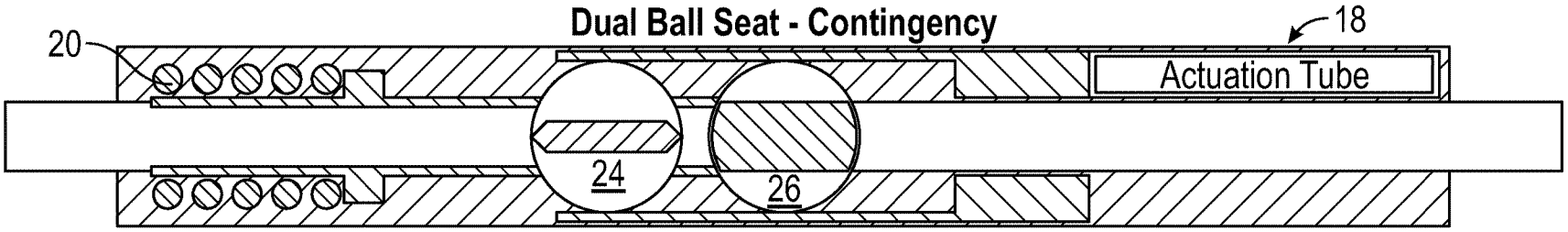

RIH Position. Spring compressed, "Blanked" Rotational Ball in the open position, and the Ball Seat Rotational Ball is in the restricted position.

FIG. 5A

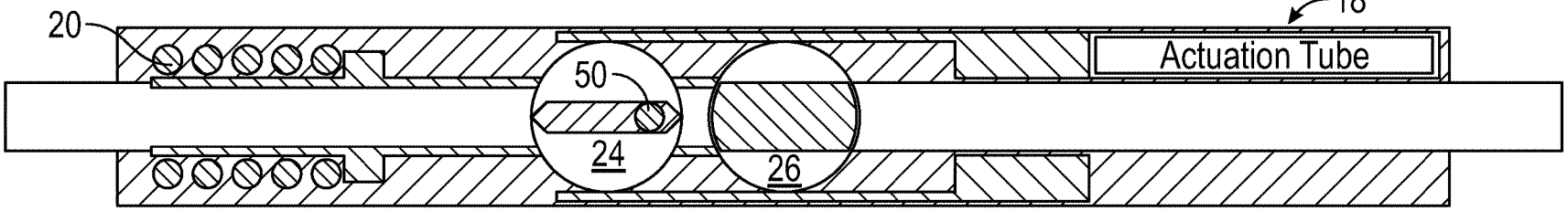

The contingency ball is released from surface and pumped to the rotational ball with a restriction in it. The operator then pressures up to set all liner hanger equipment.

FIG. 5B

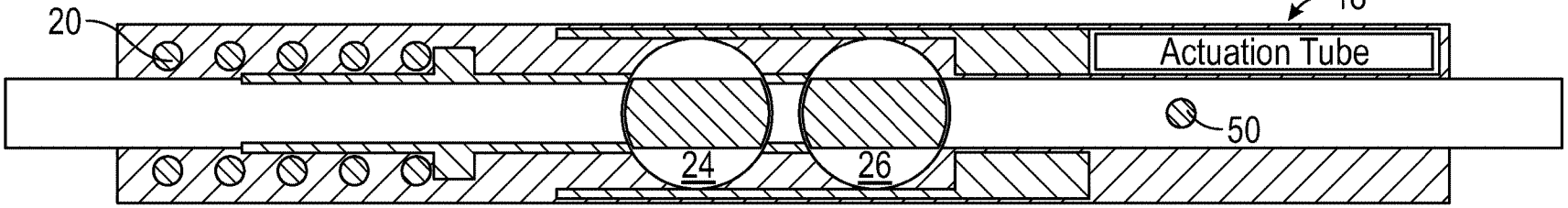

Pressure is increased until a shear event that releases the spring force and pushes both rotational balls into open position and releases the setting ball downhole.

FIG. 5C

DUAL BALL SEAT SYSTEM

CROSS-REFERENCE TO RELATED APPLICATIONS

The present application is a National Stage Entry of International Application No. PCT/US2021/060112, filed Nov. 19, 2021, which claims priority benefit of U.S. Provisional Application No. 63/121,533, filed Dec. 4, 2020, the entirety of which is incorporated by reference herein and should be considered part of this specification.

BACKGROUND

Typically, in the drilling of a well, a borehole is drilled from the earth's surface to a selected depth, and a string of casing is suspended and then cemented in place within the borehole. Thereafter, a liner may be hung either adjacent the lower end of a previously suspended and cemented casing, or from a previously suspended and cemented liner. A liner hanger is used to suspend the liner within the lower end of the previously set casing or liner. A setting tool disposed on the lower end of a work string is releasably connected to the liner hanger that is coupled with the top of the liner. The liner hanger, liner, setting tool, and other components are generally part of a liner hanger system. As the state of the relevant art transitions more and more into the digital space, there is a continuing need for remote setting and release of hydraulic actuated equipment, including liner hanger systems.

SUMMARY

A system according to one or more embodiments of the present disclosure includes a housing; a rotational ball seat section disposed within the housing, the rotational ball seat section including: a spring; a first internal sleeve; and an upper rotational ball seat including: a restricted position; and an open through bore position; a remote operated section disposed within the housing adjacent to the rotational ball seat section, the remote operated section including: a lower rotational ball valve disposed between second and third internal sleeves, wherein the lower rotational ball valve includes: an open through bore position; and a closed position; a setting sleeve operatively connected to the lower rotational ball valve; and a plurality of shear pins that hold the first, second, and third internal sleeves in place until a shear even occurs, wherein, in a run-in-hole position, the upper rotational ball seat is in the restricted position, and the lower rotational ball valve is in the open through bore position, wherein a downhole force of the spring compresses the first internal sleeve, the second internal sleeve, and the third internal sleeve such that the first, second, and third internal sleeves sandwich the upper rotational ball seat and the lower rotational ball valve in compression until the shear event occurs; and an electrical/hydraulic section that facilitates remote actuation of the remote operated section, wherein an inner diameter of the system is closed prior to the shear event to facilitate setting of hydraulic equipment, and wherein the shear event releases the downhole force of the spring, thereby pushing the first internal sleeve, the second internal sleeve, the third internal sleeve, the upper rotational ball seat, and the lower rotational ball valve downhole, which rotates the upper rotational ball seat and the lower rotational ball valve into the open through bore positions, thereby opening the inner diameter of the system.

A system according to one or more embodiments of the present disclosure includes an upper rotational ball seat; a lower rotational ball valve; a plurality of internal components; a setting sleeve; a spring; an electronic actuation device; and an atmospheric chamber, wherein firing of the electronic actuation device triggers movement of hydraulic fluid into the atmospheric chamber, thereby shifting the setting sleeve downhole, and rotating the lower rotational ball valve into a closed position to close an inner diameter of the system, wherein the upper rotational ball seat includes a restriction for receiving a contingency ball for closing the inner diameter of the system in case the lower rotational ball valve is unable to rotate into the closed position, and wherein the spring keeps the plurality of internal components in compression until a shear event, which shifts the plurality of internal components, the upper rotational ball seat, and the lower rotational ball valve downhole, thereby rotating each of the upper rotational ball seat and the lower rotational ball valve into an open position, thereby opening the inner diameter of the system.

A method of setting hydraulic equipment, including: running in hole a system including: a housing; a rotational ball seat section disposed within the housing, the rotational ball seat section comprising: a spring; a first internal sleeve; and an upper rotational ball seat including: a restricted position; and an open through bore position; a remote operated section disposed with the housing adjacent to the rotational ball seat section, the remote operated section including: a lower rotational ball valve disposed between second and third internal sleeves, wherein the lower rotational ball valve includes: an open through bore position; and a closed position; a setting sleeve operatively connected to the lower rotational ball valve; and a plurality of shear pins that hold the first, second, and third internal sleeves in place; and an electrical/hydraulic section including: an electronic actuation device; at least one power source; at least one electronic component; and an atmospheric chamber, wherein, during the running in hole stop, the upper rotational ball seat in the restricted position, and the lower rotational ball valve is in the open through bore position; compressing the first, second, and third internal sleeves with a downhole force of the spring until a shear event occurs, wherein the compressing step includes the first, second, and third internal sleeves sandwiching the upper rotational ball seat and the lower rotational ball valve; sending a signal from surface to trigger rotation of the lower rotational ball valve from the open through bore position to the closed position via the electrical/hydraulic section; if triggering rotation of the lower rotational ball valve from the open through bore position to the closed position is unsuccessful, dropping a contingency ball from the surface to land in a restriction of the upper rotational ball seat; pressuring up the system to set the hydraulic equipment; increasing pressure within the system until the shear event occurs; releasing the downhole force of the spring as a result of the shear event; shifting the first, second, and third internal sleeves in a downhole direction; and rotating the upper rotational ball seat and the lower rotational ball valve into the open through bore positions.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows:

FIGS. 4A-4C provides a sequence of the functionality of the dual ball seat system via remote actuation according to one or more embodiments of the present disclosure;

FIGS. 5A-5C provides a sequence of the functionality of the dual ball seat system via a contingency feature according to one or more embodiments of the present disclosure.

DETAILED DESCRIPTION

In the following description, numerous details are set forth to provide an understanding of some embodiments of the present disclosure. However, it will be understood by those of ordinary skill in the art that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

One or more embodiments of the present disclosure include a system and method for facilitating remote setting and release of hydraulic actuated equipment. More specifically, one or more embodiments of the present disclosure include a dual ball seat system and associated method for the remote setting and release of a hydraulic liner hanger system. Current hydraulic liner hanger systems may require a setting ball to be dropped into the wellbore and pumped to a ball seat to build the required hydraulic pressure in the system for actuation and release of the tools. Alternatively, the dual ball seat system according to one or more embodiments of the present disclosure may remotely create the pack-off needed to set and release the hydraulic liner hanger system by closing off the inner diameter (ID) of the running string. Advantageously, the dual ball seat system according to one or more embodiments of the present disclosure includes a built in contingency for setting and releasing the hydraulic liner hanger system in case the ID of the running string cannot be remotely closed.

Figure 1:
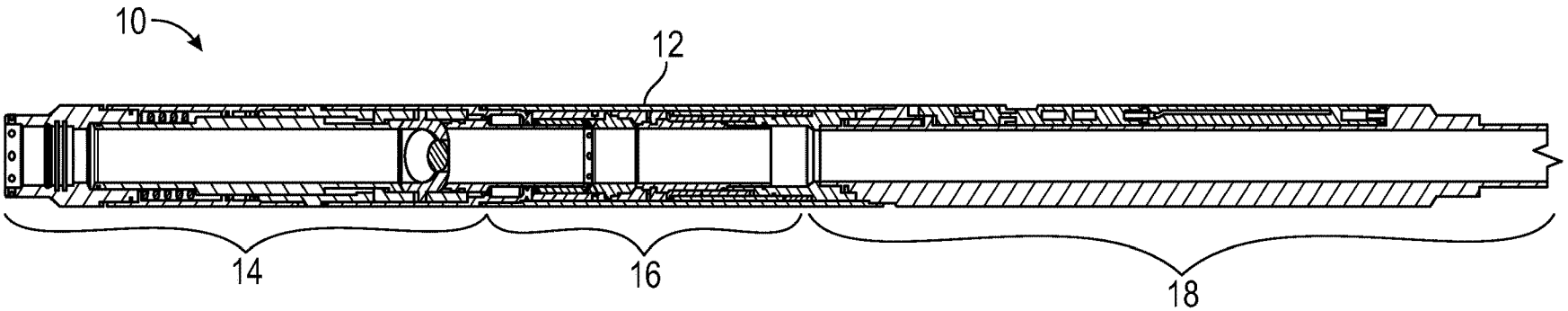
FIG. 1 is a cross-sectional view of a dual ball seat system according to one or more embodiments of the present disclosure.
Figure 2:
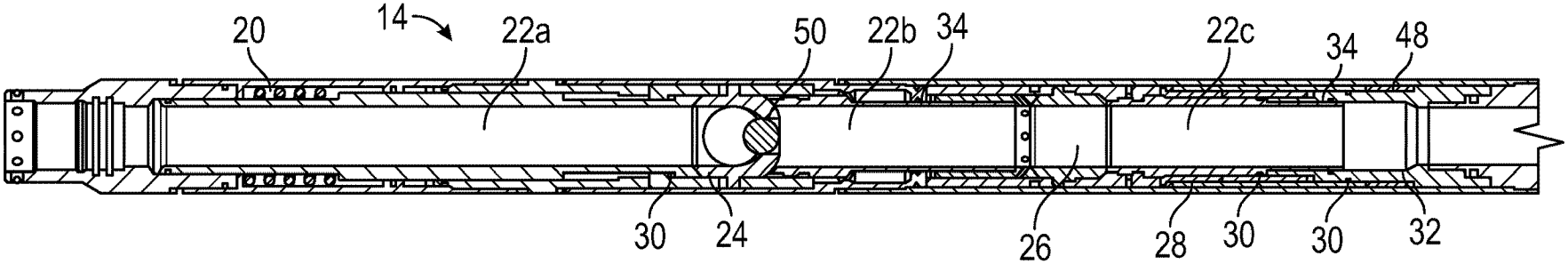
FIG. 2 is a zoomed-in partial view of FIG. 1, showing greater detail of the dual ball seat system according to one or more embodiments of the present disclosure.

Referring generally to FIG. 1, a cross-sectional view of a dual ball seat system 10 according to one or more embodiments of the present disclosure is shown. As shown in FIG. 1, the dual ball seat system 10 includes, inter alia, a housing 12, a rotation ball seat section 14 disposed within the housing 12, and a remote operated section 16 disposed within the housing 12, according to one or more embodiments of the present disclosure. FIG. 2 is a zoomed-in partial view of FIG. 1, showing greater detail of the rotational ball seat section 14 and the remote operated section 16, as further described below.

Still referring to FIG. 2, the rotational ball seat section 14 of the dual ball seat system 10 includes a spring 20, a first internal sleeve 22*a*, and an upper rotational ball seat 24, according to one or more embodiments of the present disclosure. In this way, the upper rotational ball seat 24 of the rotational ball seat section 14 is one of the ball seats of the dual ball seat system 10 according to one or more embodiments of the present disclosure. Still referring to FIG. 2, the remote operated section 16 of the dual ball seat system 10 may be disposed within the housing 12 adjacent to the rotational ball seat section 14 according to one or more embodiments of the present disclosure. Further, the remote operated section 16 of the dual ball seat system 10 may include a lower rotational ball valve 26 disposed between a second internal sleeve 22*b* and a third internal sleeve 22*c*. As further shown in FIG. 2, the remote operated section 16 may also include a setting sleeve 28 operatively connected to the lower rotational ball valve 26 according to one or more embodiments of the present disclosure. As further shown in FIG. 2, a plurality of shear pins 30 may hold, at least, the first internal sleeve 22*a*, the second internal sleeve 22*b*, and the third internal sleeve 22*c* in place until a shear event occurs, as further described below, according to one or more embodiments of the present disclosure. The remote operated section 16 may also include a bottom sub 32 downhole of the third internal sleeve 22*c* in one or more embodiments of the present disclosure. According to one or more embodiments of the present disclosure, at least one of the setting sleeve 28 and the first, second, and third internal sleeves 22*a*, 22*b*, and 22*c* may be pinned to the bottom sub 32 via the shear pins 30. Advantageously, pinning the setting sleeve 28 to the bottom sub 32 prevents movement of the setting sleeve 28 during run-in-hole and prior to actuation, as further described below. Further, pinning one or more of the first, second, and third internal sleeves 22*a*, 22*b*, and 22*c* to the bottom sub 32 prevents premature movement of the respective pinned internal sleeve, according to one or more embodiments of the present disclosure. In this way, the pinning one or more of the first, second, and third internal sleeves 22*a*, 22*b*, and 22*c* to the bottom sub 32 prevents premature opening of the lower rotational ball valve 26 and/or the upper rotational ball seat 24, according to one or more embodiments of the present disclosure.

Still referring to FIG. 2, the remote operated section 16 according to one or more embodiments of the present disclosure further comprises a plurality of internal seals 34 that seals between the second and third internal sleeves 22*b*, 22*c* and the housing 12 of the dual ball seat system 10. According to one or more embodiments of the present invention, the plurality of internal seals 34 allows pressure to be applied to either the upper rotational ball seat 24 of the rotational ball seat section 14 or the lower rotational ball valve 26 of the remote operated section 16.

Figure 3:
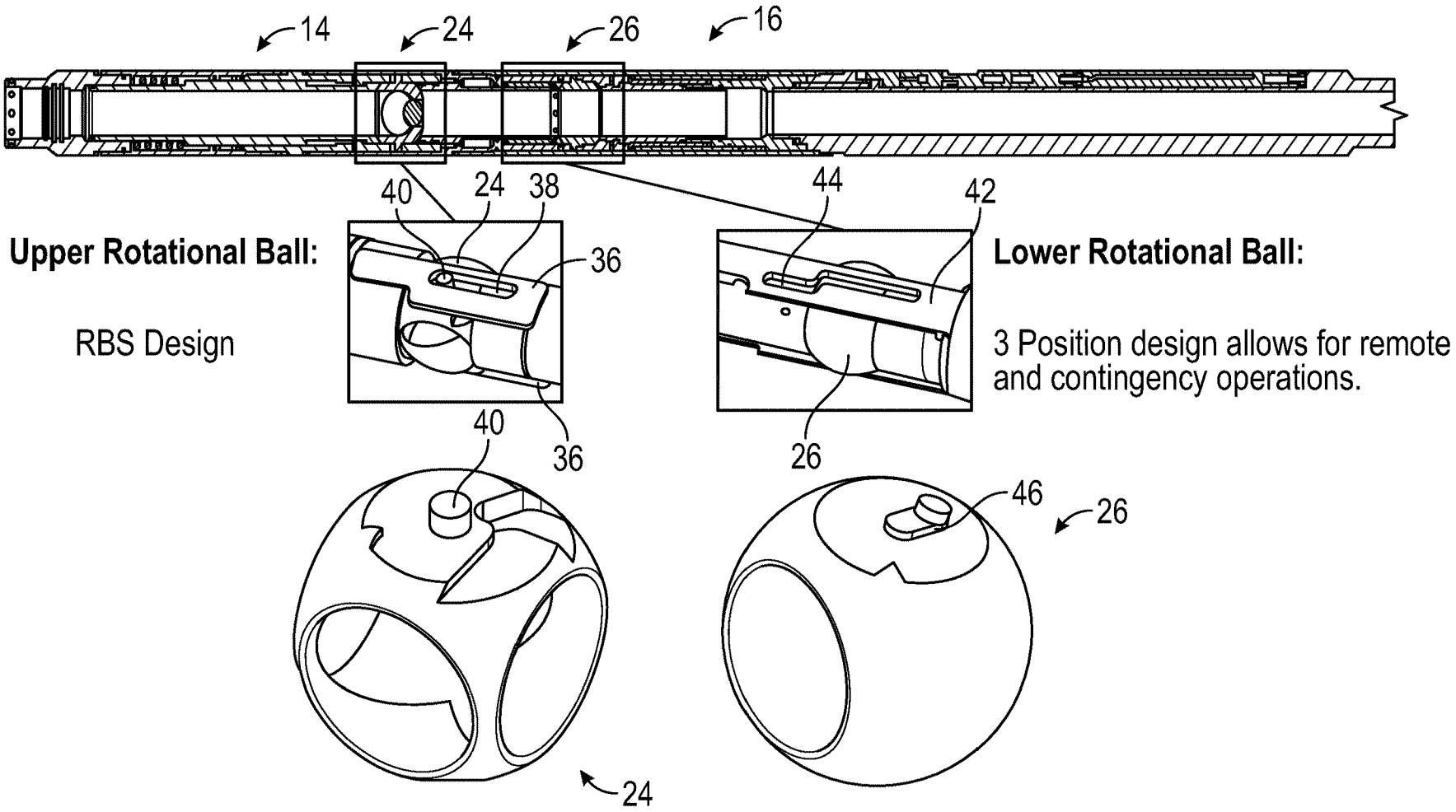
FIG. 3 shows greater detail of the rotational balls of the dual ball seat system according to one or more embodiments of the present disclosure.

Referring now to FIG. 3, greater detail of the upper rotational ball seat 24 and the lower rotational ball valve 26 of the dual ball seat system 10 according to one or more embodiments of the present disclosure is shown. The upper rotational ball seat 24 may include a restricted position and an open through bore position according to one or more embodiments of the present disclosure. Indeed, FIG. 3 shows the upper rotational ball seat 24 having a through bore in one direction and a restriction in the other direction. Further, the lower rotational ball valve 26 may include an open through bore position and a closed position according to one or more embodiments of the present disclosure. Indeed, FIG. 3 shows the lower rotational ball valve 26 having a through bore in one direction and being completely solid in the other direction to block off flow.

When the dual ball seat system 10 according to one or more embodiments of the present disclosure is in the run-in-hole position, the upper rotational ball seat 24 is in the restricted position, and the lower rotational ball valve 26 is in the open through bore position. Further, during running-in-hole, the spring 20 of the rotational ball seat section 14 is compressed. As such, the spring 20 provides a constant force downhole on all internal components of the dual ball seat system 10 to keep these internal components in compression. According to one or more embodiments of the present disclosure, the downhole force of the spring 20 compresses the first internal sleeve 22*a*, the second internal sleeve 22*b*, and the third internal sleeve 22*c* such that the first, second, and third internal sleeves 22*a*, 22*b*, and 22*c* sandwich the upper rotational ball seat 24 and the lower rotational ball valve 26 in compression during running-in-hole and until a shear event occurs, as further described below.

Referring back to FIG. 3, the rotational ball seat section 14 also includes two control arms 36 each including a slot 38, according to one or more embodiments of the present disclosure. As shown in FIG. 3, the slot 38 may be a two position longitudinal slot according to one or more embodiments of the present disclosure. As also shown in FIG. 3, the upper rotational ball seat 24 according to one or more embodiments of the present disclosure may include two pins 40, and the slots 38 of the two control arms 36 each accommodate a pin 40 of the two pins 40. According to one or more embodiments of the present disclosure, the two pins 40 facilitate rotation of the upper rotational ball seat 24 from the restricted position to the open through bore position by translating down the slots 38 of the two control arms 36 of the rotational ball seat section 14.

Still referring to FIG. 3, the remote operated section 16 also includes two control arms 42 each including a slot 44, according to one or more embodiments of the present disclosure. As shown in FIG. 3, the slot 44 may be a three position slot according to one or more embodiments of the present disclosure. As also shown in FIG. 3, the lower rotational ball valve 26 according to one or more embodiments of the present disclosure may include two features 46, and the three position slots 44 of the two control arms 42 each accommodate a feature 46 of the two features 46. According to one or more embodiments of the present disclosure, the two features 46 may be milled features 46 disposed on a flat side of the lower rotational ball valve 26, for example. According to one or more embodiments of the present disclosure the two features 46 of the lower rotational ball valve 26 in cooperation with the three position slots 44 of the two control arms 42 facilitate the remote and contingency operations of the remote operated section 16 of the dual ball seat system 10. In view of FIGS. 2 and 3, the setting sleeve 28 of the remote operated section 16 is linked to the two control arms 42 of the lower rotational ball valve 26, according to one or more embodiments of the present disclosure.

Referring back to FIG. 1, the dual ball seat system 10 according to one or more embodiments of the present disclosure also includes an electrical/hydraulic section 18 that facilitates remote actuation of the remote operated section 16. According to one or more embodiments of the present disclosure, the electrical/hydraulic section 18 may include an electronic actuation device, at least one power source such as a battery, at least one electronic component, and an atmospheric chamber, for example.

Referring back to FIG. 2, the dual ball seat system 10 may include a prefill area 48 between the housing 12, the setting sleeve 28, and the bottom sub 32, according to one or more embodiments of the present disclosure. In one or more embodiments of the present disclosure, the prefill area 48, i.e., an empty volume, may be filled with hydraulic fluid, such as hydraulic oil, for example. A signal may be sent from the surface to the electrical/hydraulic section 18 of the dual ball seat system 10 to trigger actuation. According to one or more embodiments of the present disclosure, the signal may be a pump pressure pulse signal, for example. If the electrical/hydraulic section 18 of the dual ball seat system 10 successfully receives the signal sent from the surface to trigger actuation, the electronic actuation device of the electrical/hydraulic section 18 will fire. According to one or more embodiments of the present disclosure, the electronic actuation device may include an electronic rupture disc, a motor, or a solenoid, for example. Firing of the electronic actuation device will cause the hydraulic fluid to vacate the prefill area 48 and move into the atmospheric chamber of the electrical/hydraulic section 18. The pressure differential created will be high enough to shear the setting sleeve 28 of the remote operated section 16, pulling the setting sleeve 28 downhole. Because the setting sleeve 28 is linked to the two control arms 42 of the lower rotational ball valve 26 as previously described, pulling the setting sleeve 28 downhole rotates the lower rotational ball valve 26 from the (run-in-hole) open through bore position to the closed position via the two control arms 42. Once the lower rotational ball valve 26 is in the closed position, the ID of the dual ball seat system 10 is effectively closed. Applied pressure may then be increased above the closed ID of the dual ball seat system 10 to set hydraulic equipment. According to one or more embodiments of the present disclosure, the hydraulic equipment may be a liner hanger, for example. After the hydraulic equipment is set, applied pressure above the closed ID may be further increased until a shear event occurs. According to one or more embodiments of the present disclosure, the shear event releases the downhole force of the spring 20, and pushes the first internal sleeve 22*a*, the second internal sleeve 22*b*, the third internal sleeve 22*c*, the upper rotational ball seat 24, and the lower rotational ball valve 26 downhole, which rotates the upper rotational ball seat 24 from the (run-in-hole) restricted position to the open through bore position, and the lower rotational ball valve 26 from the closed position to the open through bore position. In other embodiments of the present disclosure, the upper rotational ball seat 24 may rotate from the (run-in-hole) restricted position to the open through bore position during the closure of the lower rotational ball valve, as previously described. FIGS. 4A-4C provide a sequence of the functionality of the dual ball seat system 10 via remote actuation according to one or more embodiments of the present disclosure.

Advantageously, the dual ball seat system 10 according to one or more embodiments of the present disclosure includes a built-in contingency feature in case the signal sent from the surface to trigger actuation is not received by the electrical/hydraulic section 18, or if actuation, i.e., rotating the lower rotational ball valve 26 from the (run-in-hole) open through bore position to the closed position, fails to occur. As previously described, the upper rotational ball seat 24 is in the restricted position when the dual ball seat system 10 is run-in-hole. In this restricted position, the upper rotational ball seat 24 is able to receive a contingency ball 50 from the surface, such as shown in FIG. 2, for example, into a restriction of the upper rotational ball seat 24. Advantageously, landing the contingency ball 50 into the restriction of the upper rotational ball seat 24 effectively closes the ID of the dual ball seat system 10 such that applied pressure may be increased above the closed ID to set hydraulic equipment, as previously described. Thereafter, the method of operation proceeds as previously described, whereby after setting the hydraulic equipment, the applied pressure is increased until the shear event occurs, shifting the internal components of the dual ball seat system 10 downhole, and causing the upper rotational ball seat 24 and the lower rotational ball valve 26 to rotate into the open through bore positions, thereby fully opening the ID of the dual ball seat system 10 for subsequent downhole operations. According to one or more embodiments of the present disclosure, rotating the upper rotational ball seat 24 from the restricted position to the open through bore position in response to the shear event causes the contingency ball 50 to release from the restriction in the upper rotational ball seat 24 and fall into the ID of the system when the contingency ball 50 may be displaced downhole. FIGS. 5A-5C provide a sequence of the functionality of the dual ball seat system 10 via the contingency feature according to one or more embodiments of the present disclosure. In other embodiments of the present disclosure, the upper rotational ball seat 24 may include remote opening capabilities, for example.

Figure 6:
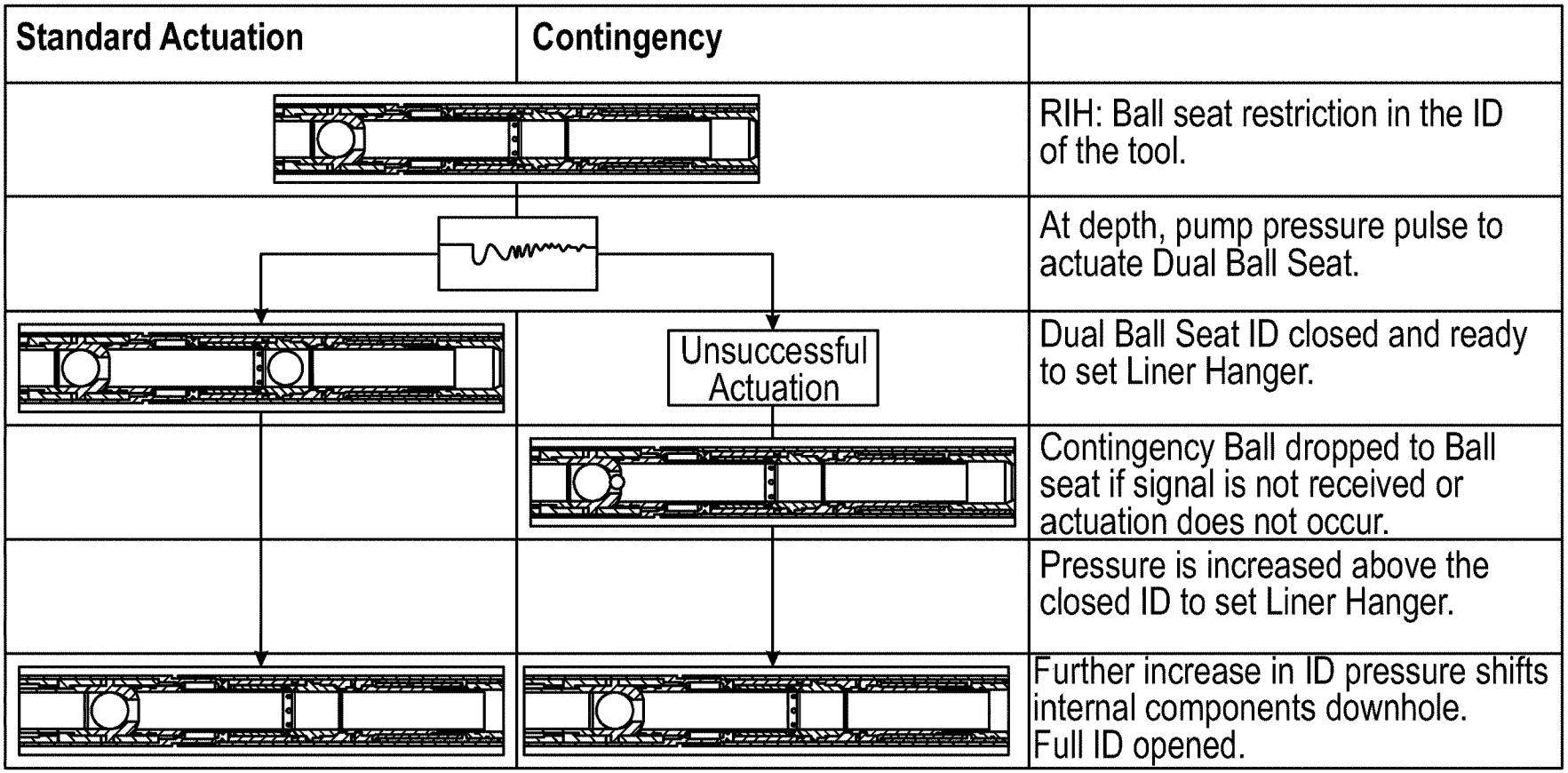
FIG. 6 provides sequences of the functionality of the dual ball seat system according to one or more embodiments of the present disclosure.

Referring now to FIG. 6, sequences of the functionality of the dual ball seat system according to one or more embodiments of the present disclosure are shown. Specifically, FIG. 6 shows a sequence of functionality of the dual ball seat system in the event of a standard, successful actuation, and a sequence of functionality that utilizes the contingency feature of the dual ball seat system in the event of an unsuccessful actuation, as previously described.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system comprising:

a housing;

a rotational ball seat section disposed within the housing, the rotational ball seat section comprising:

a spring;

a first internal sleeve; and an upper rotational ball seat comprising: a restricted position; and an open through bore position;

a remote operated section disposed within the housing adjacent to the rotational ball seat section, the remote operated section comprising:

a lower rotational ball valve disposed between second and third internal sleeves, wherein the lower rotational ball valve comprises: an open through bore position; and a closed position;

a setting sleeve operatively connected to the lower rotational ball valve; and a plurality of shear pins that hold the first, second, and third internal sleeves in place until a shear event occurs, wherein, in a run-in-hole position, the upper rotational ball seat is in the restricted position, and the lower rotational ball valve is in the open through bore position, wherein a downhole force of the spring compresses the first internal sleeve, the second internal sleeve, and the third internal sleeve such that the first, second, and third internal sleeves sandwich the upper rotational ball seat and the lower rotational ball valve in compression until the shear event occurs; and an electrical/hydraulic section that facilitates remote actuation of the remote operated section, wherein an inner diameter of the system is closed prior to the shear event to facilitate setting of hydraulic equipment, and wherein the shear event releases the downhole force of the spring, thereby pushing the first internal sleeve, the second internal sleeve, the third internal sleeve, the upper rotational ball seat, and the lower rotational ball valve downhole, which rotates the upper rotational ball seat and the lower rotational ball valve into the open through bore positions, thereby opening the inner diameter of the system.

2. The system of claim 1, wherein the inner diameter of the system is closed by the remote actuation of the remote operated section shifting the setting sleeve downhole, thereby rotating the lower rotational ball valve into the closed position.

3. The system of claim 1, wherein the inner diameter of the system is closed by a contingency ball landed in a restriction of the upper rotational ball seat when the upper rotational ball seat is in the restricted position.

4. The system of claim 3, wherein the contingency ball is released from the upper rotational ball seat when the upper rotational ball seat assumes the open through bore position after the shear event.

5. The system of claim 1, wherein the rotational ball seat section further comprises two control arms each comprising a slot, wherein the upper rotational ball seat further comprises two pins, wherein the slots of the two control arms each accommodate a pin of the two pins, and wherein the two pins facilitate rotation of the upper rotational ball seat from the restricted position to the open through bore position by translating down the slots of the two control arms.

6. The system of claim 1, wherein the remote operated section further comprises two control arms each comprising a three position slot, wherein the lower rotational ball valve further comprises two features, wherein the three position slots of the two control arms each accommodate a feature of the two features, and wherein the two features of the lower rotational ball valve in cooperation with the three position slots of the two control arms facilitate remote and contingency operations of the remote operated section.

7. The system of claim 5, wherein the remote operated section further comprises two control arms each comprising a three position slot, wherein the lower rotational ball valve further comprises two features, wherein the three position slots of the two control arms each accommodate a feature of the two features, and wherein the two features of the lower rotational ball valve in cooperation with the three position slots of the two control arms facilitate remote and contingency operations of the remote operated section.

8. The system of claim 1, wherein the remote operated section further comprises a bottom sub downhole of the third internal sleeve, and wherein the setting sleeve is shear pinned to the bottom sub.

9. The system of claim 6, wherein the remote operated section further comprises a bottom sub downhole of the third internal sleeve, wherein the setting sleeve is shear pinned to the bottom sub, and wherein the setting sleeve is linked to the two control arms of the lower rotational ball valve.

10. The system of claim 1, wherein the remote operated section further comprises a plurality of internal seals that seals between the second and third internal sleeves and the housing.

11. The system of claim 9, wherein the electrical/hydraulic section comprises: an electronic actuation device; at least one power source; at least one electronic component; and an atmospheric chamber.

12. The system of claim 11, further comprising a prefill area between the housing, the setting sleeve, and the bottom sub.

13. The system of claim 12, wherein the prefill area contains hydraulic oil that vacates the prefill area and moves into the atmospheric chamber upon firing of the electronic actuation device, thereby shearing the setting sleeve and pulling the setting sleeve downhole to rotate the lower rotational ball valve via the two control arms of the lower rotational ball valve.

14. A system, comprising:

an upper rotational ball seat;

a lower rotational ball valve;

a plurality of internal components;

a setting sleeve;

a spring;

an electronic actuation device; and an atmospheric chamber, wherein firing of the electronic actuation device triggers movement of hydraulic fluid into the atmospheric chamber, thereby shifting the setting sleeve downhole, and rotating the lower rotational ball valve into a closed position to close an inner diameter of the system, wherein the upper rotational ball seat comprises a restriction for receiving a contingency ball for closing the inner diameter of the system in case the lower rotational ball valve is unable to rotate into the closed position, and wherein the spring keeps the plurality of internal components in compression until a shear event, which shifts the plurality of internal components, the upper rotational ball seat, and the lower rotational ball valve downhole, thereby rotating each of the upper rotational ball seat and the lower rotational ball valve into an open position, thereby opening the inner diameter of the system.

15. The system of claim 14, wherein the closed inner diameter of the system allows applied pressure to increase above the closed inner diameter to set hydraulic equipment.

16. A method of setting hydraulic equipment, comprising:

running in hole a system comprising:

a housing;

a rotational ball seat section disposed within the housing, the rotational ball seat section comprising:

a spring;

a first internal sleeve; and an upper rotational ball seat comprising: a restricted position; and an open through bore position;

a remote operated section disposed with the housing adjacent to the rotational ball seat section, the remote operated section comprising:

a lower rotational ball valve disposed between second and third internal sleeves, wherein the lower rotational ball valve comprises: an open through bore position; and a closed position;

a setting sleeve operatively connected to the lower rotational ball valve; and a plurality of shear pins that hold the first, second, and third internal sleeves in place; and an electrical/hydraulic section comprising: an electronic actuation device; at least one power source; at least one electronic component; and an atmospheric chamber, wherein, during the running in hole step, the upper rotational ball seat is in the restricted position, and the lower rotational ball valve is in the open through bore position;

compressing the first, second, and third internal sleeves with a downhole force of the spring until a shear event occurs, wherein the compressing step comprises the first, second, and third internal sleeves sandwiching the upper rotational ball seat and the lower rotational ball valve;

sending a signal from surface to trigger rotation of the lower rotational ball valve from the open through bore position to the closed position via the electrical/hydraulic section;

if triggering the rotation of the lower rotational ball valve from the open through bore position to the closed position is unsuccessful, dropping a contingency ball from the surface to land in a restriction of the upper rotational ball seat;

pressuring up the system to set the hydraulic equipment;

increasing pressure within the system until the shear event occurs;

releasing the downhole force of the spring as a result of the shear event;

shifting the first, second, and third internal sleeves, the upper rotational ball seat, and the lower rotational ball valve in a downhole direction; and rotating the upper rotational ball seat and the lower rotational ball valve into the open through bore positions.

17. The method of claim 16, further comprising: releasing the contingency ball from the upper rotational seat after the rotating step.

18. The method of claim 16, wherein the remote operated section further comprises: two control arms each comprising a three position slot; and a bottom sub downhole of the third internal sleeve, wherein the lower rotational ball valve further comprises two features, wherein the three position slots of the two control arms each accommodate a feature of the two features, and wherein the setting sleeve is shear pinned to the bottom sub, and linked to the two control arms of the lower rotational ball valve, the system further comprising: a prefill area between the housing, the setting sleeve, and the bottom sub, the method further comprising:

firing the electronic actuation device after the sending the signal from the surface step;

moving hydraulic fluid from the prefill area to the atmospheric chamber;

shearing the setting sleeve, thereby pulling the setting sleeve downhole to rotate the lower rotational ball valve to the closed position via the two control arms of the lower rotational ball valve, wherein the shearing the setting sleeve step occurs before the pressuring up the system to set the hydraulic equipment step.

* * * * *